US006000720A

United States Patent [19]

Iannarelli et al.

[11] Patent Number: 6,000,720

[45] Date of Patent: Dec. 14, 1999

[54] TANK MOUNTING ARRANGEMENT AND METHOD

[75] Inventors: Philip A. Iannarelli, Burlington, Iowa; Marvin L. Linder, Stronghurst, Ill.; Robert E. Mozingo, Burlington, Iowa

[73] Assignee: Case Corporation, Racine, Wis.

[21] Appl. No.: 08/916,839

[22] Filed: Aug. 25, 1997

[51] Int. Cl.[6] ..... B60P 3/22

[52] U.S. Cl. ..... 280/830; 411/526

[58] Field of Search ..... 280/830, 831, 280/838, 839; 411/525, 526, 331, 351

[56] References Cited

U.S. PATENT DOCUMENTS 2,552,066 5/1951 Sorensen .
2,993,721 7/1961 Bowman .
4,234,050 11/1980 Condon ..... 180/190

*Primary Examiner*—Chris Schwartz
*Assistant Examiner*—C. T. Bartz
*Attorney, Agent, or Firm*—Jansson, Shupe, Bridge & Munger, Ltd.

[57] ABSTRACT

The disclosure involves the combination of a vehicle chassis such as that used on a construction machine, e.g., a loader/backhoe. The chassis has a channel and a holding tank, e.g., a hydraulic oil tank, supported on the channel by first and second tank mounting ears. In the improvement, the channel includes a panel having outer and inner surfaces and first and second mounting plates are against the inner surface. First and second mounting fasteners extend through the first and second tank mounting ears, respectively, through the chassis panel and into the first and second mounting plates, respectively. A new method for mounting a holding tank to a vehicle chassis is also disclosed.

9 Claims, 5 Drawing Sheets

TANK MOUNTING ARRANGEMENT AND METHOD

FIELD OF THE INVENTION

This invention relates generally to mounting a tank to a surface and, more particularly, to a structure and method for mounting a liquid-containing tanks to a vehicle chassis.

BACKGROUND OF THE INVENTION

Many vehicles use mounted tanks to contain liquids necessary for vehicle operation. Such liquids include hydraulic oil, gasoline and water, as examples. Although it is believed that federal regulations require that such tanks be mounted internally on vehicles designed for highway or on-road use, off-road vehicles such as those used in the farming or construction industry often employ (and are permitted to employ) externally-mounted tanks, i.e., tanks visible and accessible to the operator. Off-road vehicles are subjected to vibration, sometimes severe, as they travel over uneven terrain and as they are operated.

A known approach to mounting a hydraulic tank to a vehicle such as a loader/backhoe having a pair of box-like chassis channels uses short, cylindrical tapped bosses welded to the relatively-thick plate forming a side of a channel. At one tank side, the tank has mounting ears and threaded fasteners extend through the ears and thread into respective bosses. It might be said that the tank is cantilever-mounted in that the tank center of gravity is spaced outwardly away from the mounting ears. While this approach is generally satisfactory, it is not without problems.

One problem is known as "oil canning" and occurs during normal vehicle operation. Even though the plate to which the bosses are welded is relatively thick, such plate flexes along lines which represent "stress risers," i.e., lines of high localized metal stress. Over time, this causes tiny fatigue cracks to form in the plate and the chassis channel is thereby weakened and may even fracture. And plate flexing is not the only problem.

Vibration occurring during normal vehicle operation causes what is known as fatigue cracking of the welds securing the threaded bosses to the plate. In an extreme case, weld cracking becomes so severe that a particular boss separates from the channel plate to which it is mounted and becomes ineffective in supporting the considerable weight of the tank and its contents.

And normal vehicle operation is not the only factor which can causes oil-canning and weld cracking. In one known tank mounting arrangement, a step is mounted on the tank outer edge lateral to the tank mounting ears. Such step is used by the operator to gain access to the vehicle cab and when alighting from the vehicle. When the step is so mounted and used, the operator's weight as well as that of the tank and its contents are cantilever-supported by the welded bosses.

Chassis channel cracking and weld breakage often lead to vehicle "downtime." That is, the vehicle must be taken out of service and repaired—during time spent in repair, the vehicle owner does not get the economic benefit of the monetary investment in the machine.

An improved structure and method for mounting a liquid-holding tank to a vehicle chassis in a way which eliminates "oil canning," weld cracking and other forms of metal fatigue would be an important advance in the art.

OBJECTS OF THE INVENTION

An object of the invention is to provide an improved structure and method for mounting an external holding tank to the side of a vehicle that overcome some of the problems and shortcomings of the prior art.

Another object of the invention is to provide an improved structure and method for mounting an external tank to the side of a vehicle that eliminate the need for welding.

Still another object of the invention is to provide an improved structure and method for mounting an external tank to the side of a vehicle that distribute forces acting on the vehicle, thereby reducing the possibility of metal fatigue.

Yet another object of the invention is to provide an improved structure and method for mounting an external tank to the side of a vehicle that reduces manufacturing costs.

Another object of the invention is to provide an improved structure and method for mounting an external tank to the side of a vehicle which helps reduce vehicle downtime. How these and other objects are accomplished will become apparent from the following descriptions and from the drawings.

SUMMARY OF THE INVENTION

One aspect of the invention involves the combination of a vehicle chassis having a plate-fabricated channel and a holding tank supported on the channel by first and second tank mounting ears. An exemplary tank is a hydraulic tank holding hydraulic fluid, e.g., oil.

In the improvement, first and second spaced-apart mounting plates are positioned against the inner surface of one of the channel plates. First and second mounting fasteners, e.g., cap screws or the like, extend through the first and second tank ears, respectively, through the panel, and are threaded into the first and second mounting plates, respectively.

The first and second mounting plates each have a first surface toward the inside surface of the panel. Most preferably, substantially the entirety of each of the first surfaces contacts the panel to spread the weight of the tank across the first surfaces and across a substantial area of the panel. And in a very specific embodiment, the plates and the panel against which the plates bear are substantially flat.

In a more specific embodiment, first and second retention fasteners extend between the first and second mounting plates, respectively, and the panel. The retention fasteners are used to hold the mounting plate in a fixed position until the tank mounting ears can be attached to the mounting plates. Each of the retention fastener has a head, and each mounting ear includes a clearance aperture in registry with the respective head when such ear is attached to the panel and the respective mounting plate. In that way, the mounting plates can first be attached to the channel and then the mounting ears attached to the plates. Each clearance aperture permits an ear to abut the plate; that is, the retention bolt head will not interfere with tank ear attachment.

In a specific embodiment, each of the mounting plates include a plurality of mounting holes, i.e., two for the tank fasteners and one for the plate retention fastener. The plurality of mounting holes and the retention fastener are positioned along (i.e., in registry with) a linear axis.

Another specific aspect the invention relates to the dimension between plate mounting holes, the dimension between the tank mounting ears, and the relationship of the dimensions to one another. Each of the mounting plates includes a plurality of mounting holes spaced apart by a first dimension. Such spacing is generally vertical. The first and second mounting fasteners extend through mounting holes in the first and second tank mounting ears and such ears are spaced apart by a second dimension which is at least six times the first dimension. To put it in different terms, the vertical spacing between holes in a particular mounting plate is relatively small compared to the horizontal spacing between tank mounting ears.

Another aspect of the invention involves a method for mounting a holding tank to a vehicle chassis. Such method includes the steps of: (1) providing an elongate chassis structure having a plurality of panels and a structure interior; (2) supplying a plurality of mounting plates, each having a pair of plate mounting holes therein; and (3) furnishing a holding tank having a pair of spaced-apart mounting ears, each including a pair of ear mounting holes. The mounting plates are inserted into the interior of the chassis structure and affixed to one of the panels. Each tank mounting ear is then attached to its respective mounting plate.

In one embodiment of the invention, the chassis structure is fabricated of metal plates welded together. In an intermediate stage before the last plate is welded in place to close a slot and form a totally-enclosed channel, the slot extends along the structure length. The inserting step includes moving the plates through the slot to the structure interior.

In still another embodiment of the invention, the affixing step includes extending a separate retention fastener through one of the panels and threading each retention fastener to a respective one of the mounting plates. In such embodiment, the chassis panel has a plurality of apertures therethrough, e.g., two for the mounting fasteners of each tank ear and plate and one for the retention fastener of each plate. The affixing step includes aligning the plate mounting holes of each plate with a respective one of the plurality of apertures. And the affixing step is followed by the step of welding a strip along the slot, thereby forming an enclosed chassis channel.

Other aspects of the invention are set forth in the following detailed description and in the drawings.

DETAILED DESCRIPTIONS OF THE PREFERRED EMBODIMENTS

Figure 1:
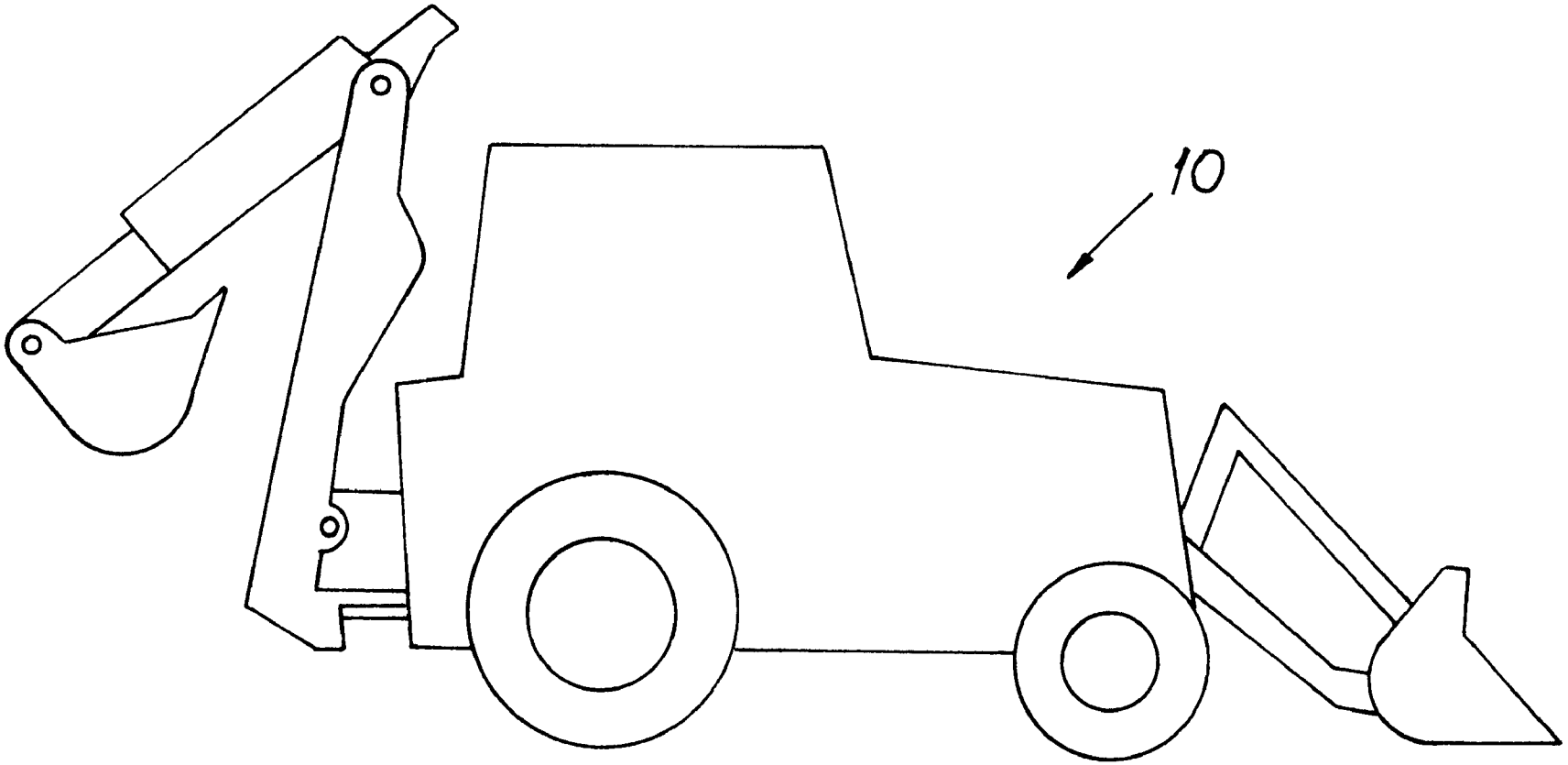
FIG. 1 is a representative side elevation view of an exemplary loader/backhoe on which the invention may be used.
Figure 2:
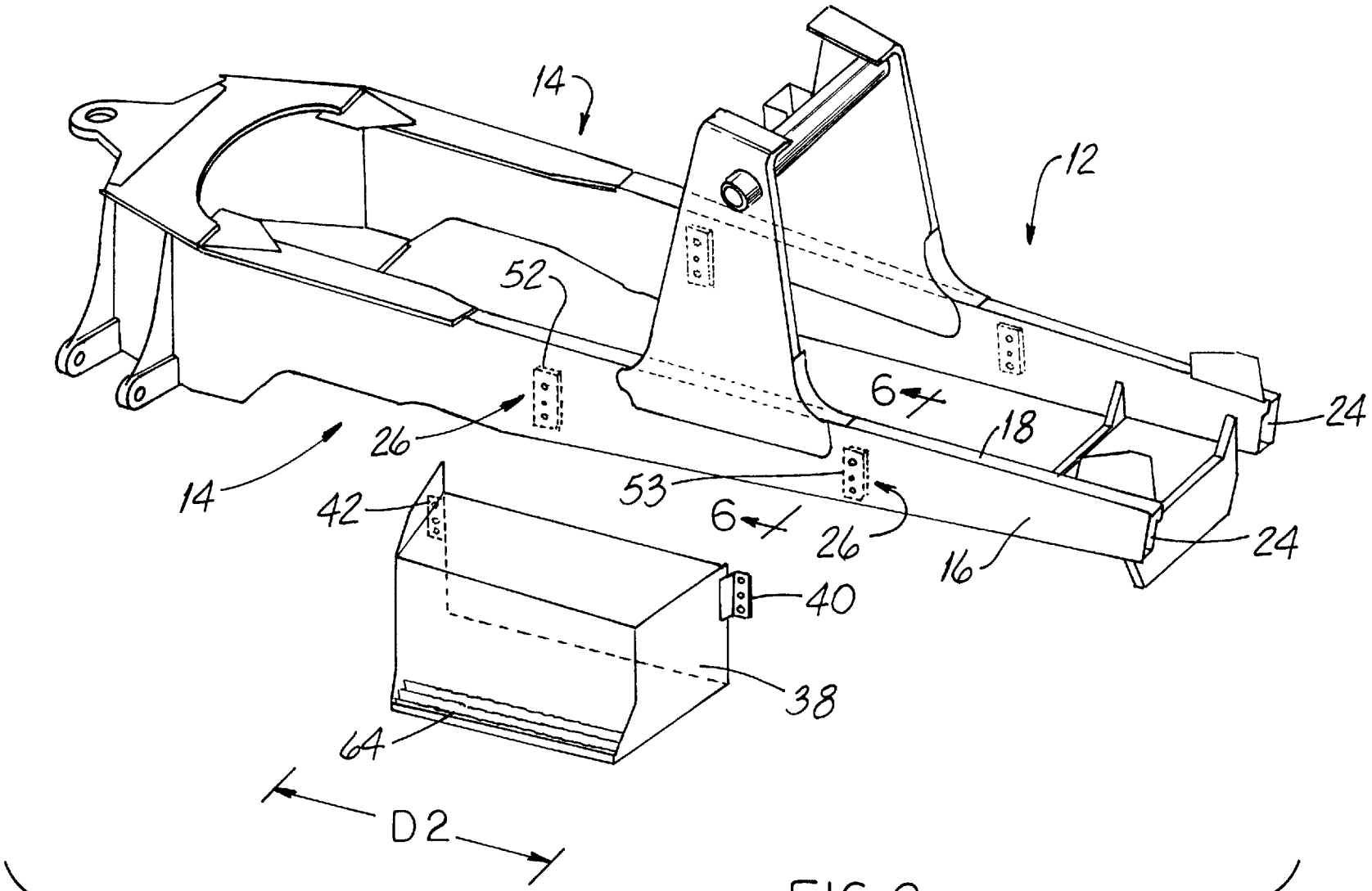
FIG. 2 is perspective view of the fabricated chassis of the loader/backhoe shown in FIG. 1 and a perspective view of a holding tank used with such loader/backhoe.

FIGS. 1 and 2 show, respectively, a loader/backhoe 10 and the chassis component 12 used in such loader/backhoe 10, both of which are examples of the type of vehicle and chassis used in conjunction with the invention.

Figure 6:
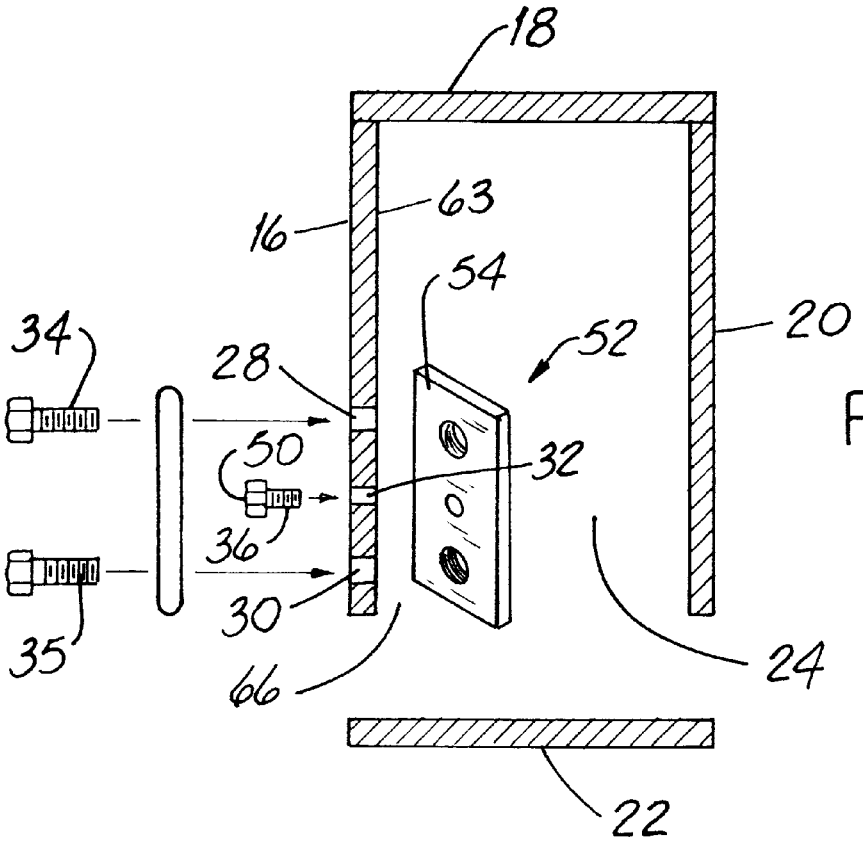
FIG. 6 is a sectional view taken along line 6—6 of FIG. 2 showing the interior cavity of the chassis channel, a mounting plate, a side view of a tank mounting ear and the mounting and retention fasteners used to secure the tank to the chassis panel.

Referring particularly to FIGS. 2 and 6, the chassis 12 and, particularly, the spaced-apart channels 14 are each fabricated of substantially flat plates or panels welded together. When channel fabrication is complete, the resulting channel 14 has four panels 16, 18, 20 and 22, respectively, is rectangular in cross-section and has an interior cavity 24.

Figure 3:
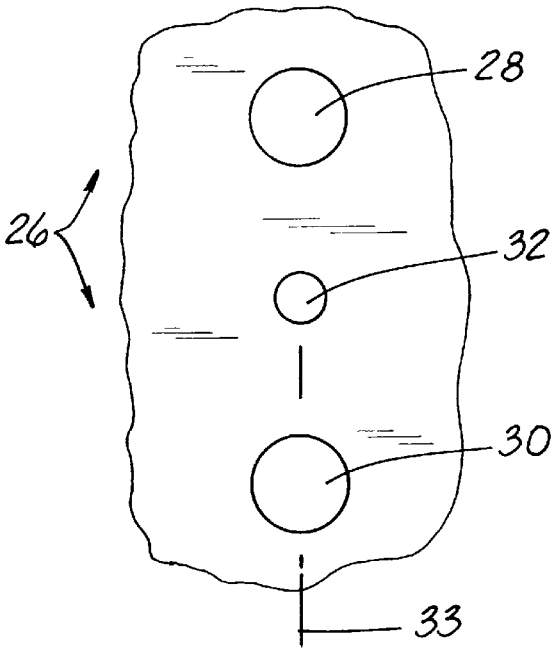
FIG. 3 is a cutaway of a portion of the chassis shown in FIG. 2 showing a set of the mounting and retention apertures located on one of the chassis panels.

For tank mounting, the panel 16 includes two sets 26 of apertures 28, 30 (formed before or after welding the panel 16), one set 26 of which is shown in FIG. 3. Each set 26 includes a pair of vertically-spaced-apart mounting apertures 28, 30 and a retention aperture 32 positioned between the apertures 28, 30. Each mounting aperture 28, 30 is sized to receive the threaded portion of a mounting fastener 34, 35 with slight clearance. Similarly, each retention aperture 32 is sized to receive the threaded portion of a retention fastener 36 with slight clearance. In a specific embodiment, the apertures 28, 30, 32 are located to be in registry with the axis 33.

An exemplary holding tank 38, e.g., a hydraulic tank holding hydraulic fluid, to be mounted on a channel 14 includes spaced-apart first and second tank mounting ears 40, 42. As shown in the ear 42 in FIG. 4, each ear 40, 42 includes a pair of vertically-spaced-apart mounting holes 44, 46 and a retention fastener clearance hole 48 between the mounting holes 44, 46. Each mounting hole 44, 46 is sized to receive the threaded portion of a mounting fastener 34, 35 with slight clearance but such hole 44, 46 is sufficiently small that the head of such fastener 34, 35 cannot pass through it. Each retention hole 48 constitutes a clearance hole in that it is sized to receive the head 50 of a retention fastener 36 with slight clearance. In that way, the head 50 can extend through the ear 42 and thereby permit the ear 42 to be mounted in solid abutment with the panel 16.

Figure 5:
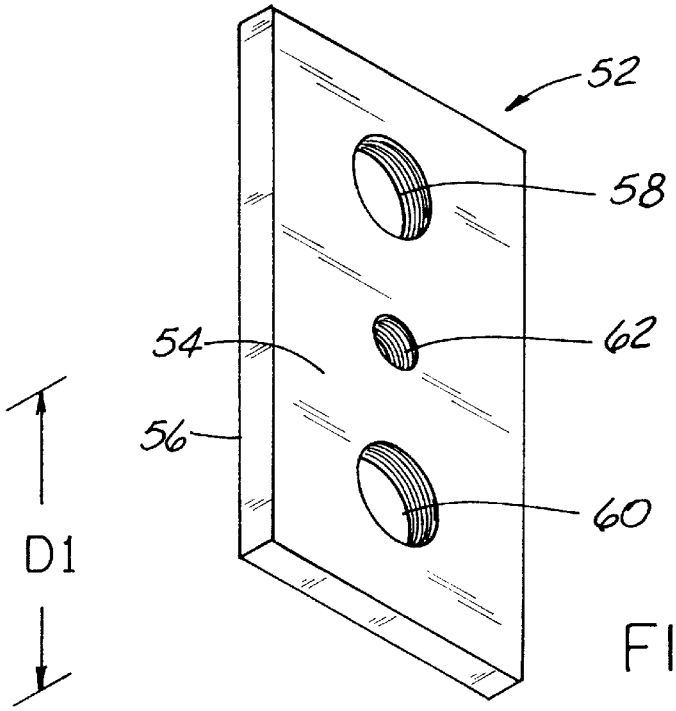
FIG. 5 is a perspective of a tank mounting plate.
Figure 7:
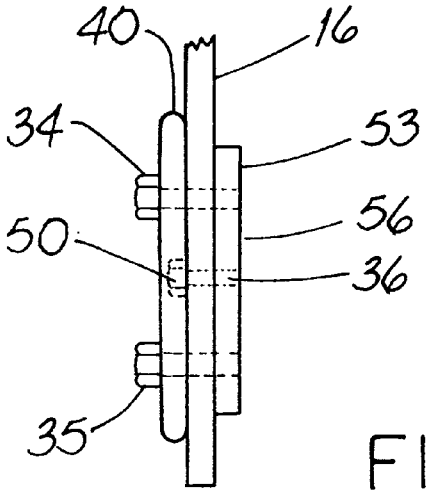
FIG. 7 is a side view of a portion of a chassis panel showing the mounting and retention fasteners securing the tank ear and mounting plate to the panel.

Referring now to FIGS. 5, 6 and 7, the invention also involves two mounting plates 52, one of which is shown in FIG. 5. In a specific embodiment, the plates 52 are substantially identical, each plate 52 is rectangular and has first and second surfaces 54, 56, respectively, which are substantially flat. Each plate 52 includes a pair of threaded tank fastener openings 58, 60 the center spacing of which is substantially equal to the spacing between a related pair of apertures 28, 30 and a related pair of holes 44, 46. Each opening 58, 60 is tapped to receive the threaded portion of a tank mounting fastener 34, 35.

Each plate 52 also includes a threaded retention fastener opening 62. Such opening 62 is sized to receive the threaded portion of a plate retention fastener 36.

It is also to be appreciated that other aperture and hole patterns may be successfully used to practice the invention. That is, the apertures 28, 30, 32 the holes 44, 46, 48 and the openings 58, 60, 62 need not be axially aligned. The only requirement, of course, is that the apertures 28, 30, 32; holes 44, 46, 48 and openings 58, 60, 62 are laid out in the same pattern.

Referring now to FIGS. 6 and 7, the first and second spaced-apart mounting plates 52 are positioned against the inner surface of panel 16. The plates 52, each have their first surface 54 oriented toward and against the inside surface 63 of the panel 16. Most preferably, substantially the entirety of each of such first surfaces 54 contacts surface 63 of the panel 16 to spread the weight of the tank 38 across the first surfaces 54 and across a substantial area of the panel 16. (While flat panels 16 and plates 52 are preferred at least for ease of fabrication, it is to be understood that curved or otherwise-shaped panels 16 and plates 52 will serve well so long as a panel 16 and the plates 52 thereagainst are conformably shaped for load spreading.)

FIG. 7 shows a retention fastener 36 extending through the aperture 32 in the panel 16 and into the retention opening 62 of the second mounting plate 53. The plate 52 is assembled to the panel 16 in like manner. The retention fasteners 36 are used to hold the mounting plates 52, 53 in a fixed position until the tank mounting ears 40, 42 can be attached to the mounting plates 52, 53. That is, such fasteners 36 are used only during assembly to hold respective plates 52, 53 in place against the panel 16. Since such fasteners 36 bear little or no tank weight, they may be significantly smaller than the mounting fasteners 34, 35.

Figure 4:
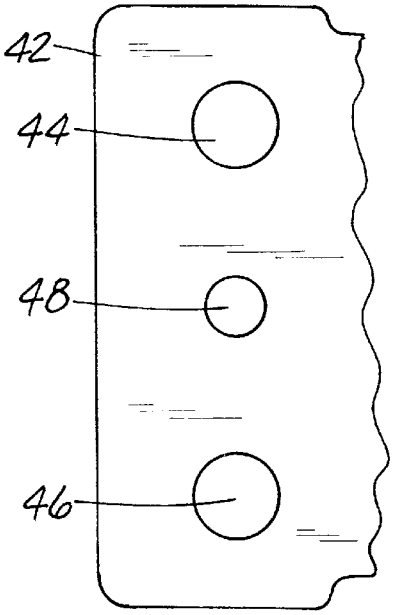
FIG. 4 is a cutaway of a mounting ear shown on the holding tank in FIG. 2.

As seen in FIGS. 4, 6 and 7, each of the retention fastener 36 has a head 50. Each mounting ear 40, 42 includes a clearance hole 48 in registry with the respective head 50 when such ear 42, 43 is attached to the panel 16 and the respective mounting plate 52, 53. In that way, the mounting plates 52, 53 can first be attached to the channel 14 and then the mounting ears 40, 42 attached to the plates 53, 52. Each clearance aperture 48 permits an ear 40, 42 to abut the panel 16. That is, the retention bolt head 50 will not interfere with tank ear attachment.

First and second mounting fasteners 34, 35, e.g., cap screws or the like, extend through respective holes 44, 46 in the first and second tank ears 40, 42, respectively, and through respective apertures 28, 30 in the panel 16. The fasteners 34, 35 are threaded into respective openings 28, 30 in the first and second mounting plates 52, 53, respectively.

As shown in FIGS. 2 and 5, another specific aspect of the invention relates to the dimension between plate mounting openings 58, 60 the dimension between the tank mounting ears 40, 42, and the relationship of the dimensions to one another. Each of the mounting plates 52, 53 includes a plurality of mounting openings 58, 60 spaced apart by a first dimension D1. (Note that FIGS. 2 and 5 are not drawn to the same scale.) Such spacing is generally vertical. The tank mounting ears 40, 42 are spaced apart by a second dimension D2 which is at least six times the first dimension D1. To put it in different terms, the vertical spacing D1 between holes 58, 60 in a particular mounting plate 52, 53 is relatively small compared to the horizontal spacing D2 between tank mounting ears 40, 42. Such spacing enables one to mount larger-capacity tanks 38 on a chassis channel 14 shaped like that shown in FIG. 2.

Figure 8:
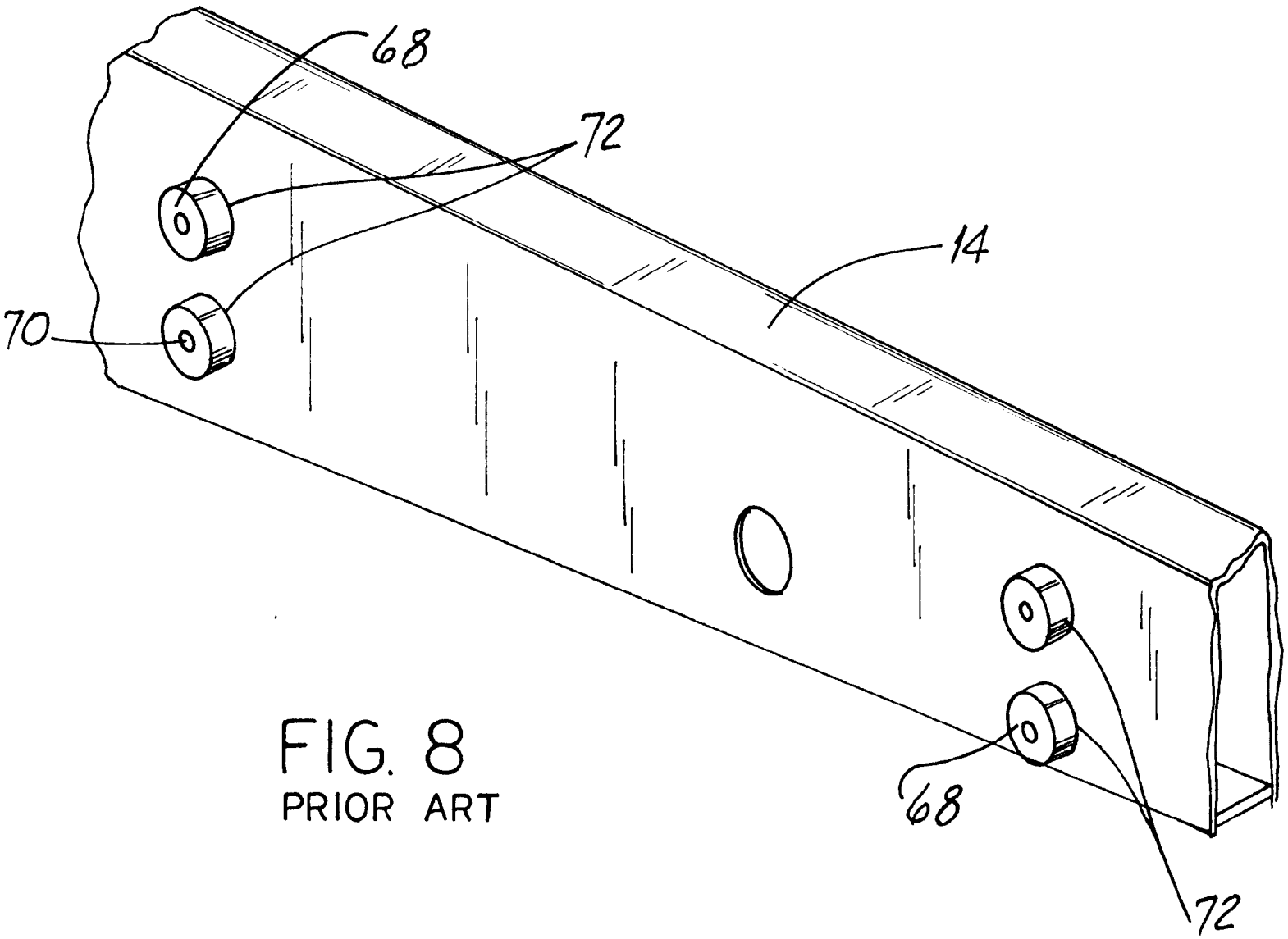
FIG. 8 PRIOR ART
FIG. 8 is a perspective of a chassis channel showing a prior art mounting apparatus of tapped boss welded to the chassis panel.

Considering FIG. 2, a specific hydraulic tank 38 includes a step 64 extending away from the tank 38 and the channel 14. Conveniently, an operator uses such step 64 to board and alight from the loader/backhoe 10. And in view of the fact that the tank center of gravity is spaced from the channel 14 and that an operator's center of gravity is further yet from the channel 14, the "levered" force tending to flex the panel 16 and crack welds on the prior art arrangement shown in FIG. 8 is not surprising.

Referring next to FIGS. 2, 6 and 7, another aspect of the invention involves a method for mounting a holding tank 38 to a vehicle chassis 14. Such method includes the steps of: (1) providing an elongate chassis structure 12 having a channel 14 with a plurality of panels 16, 18, 20, 22 and a structure interior cavity 24; (2) supplying a plurality of mounting plates 52, 53 each having a pair of plate mounting openings 58, 60 therein; and (3) furnishing a holding tank 38 having a pair of spaced-apart mounting ears 40, 42 each including a pair of ear mounting holes 44, 46. The mounting plates 52, 53 are inserted into the cavity 24 of the not-yet-completed channel 14 and affixed to one of the panels 16 using retention fasteners 36. Each tank mounting ear 40, 42 is then attached to its respective mounting plate 52, 53.

FIGS. 2 and 6 show one embodiment of the invention in which the chassis structure 12 is fabricated of metal plates 16, 18, 20, 22 welded together. In an intermediate stage before the last plate 22 is welded in place to close a slot and form a totally-enclosed channel 14, the slot 24 extends along the structure length. The inserting step includes moving the plates 52, 53 through the slot 24 to the structure interior cavity 24.

In a more specific aspect of the method, the affixing step includes extending a separate retention fastener 36 through one of the panels 16 and threading each retention fastener 36 to a respective one of the mounting plates 52, 53. The affixing step includes aligning the mounting openings 58, 60 of each plate 52, 53 with a respective one of the plurality of apertures 28, 30 in the panel 16. And the affixing step is followed by the step of affixing (as, e.g., by welding) a strip-like panel 22 along the slot 24, thereby forming an enclosed chassis channel 14.

Referring now to FIG. 8, a prior art arrangement for attaching a tank 38 to a channel 14 involves several disc-shaped mounting bosses 68, each having a tapped hole 70 for receiving a fastener 34, 35 to secure a tank ear 40, 42 thereto. Each boss 68 is attached to the channel 14 by a circumferential bead of weld applied at the location 72. Localized stresses are high, the welds cracked and the aforedescribed "oilcanning" or flexing of the panel 16 caused stress cracks and premature failure.

While the principles of the invention have been shown and described in connection with but a few embodiments, it is to be understood clearly that such embodiments are by way of example and are not limiting.

What is claimed:

1. In the combination of a vehicle chassis having a channel and a holding tank supported on the channel by first and second tank mounting ears, the improvement wherein:

the channel includes a panel having outer and inner surfaces;

first and second mounting plates are against the inner surface, the first and second mounting plates each have a first surface such that substantially the entirety of each of the first surfaces contacts the panel;

and wherein first and second mounting fasteners extend:

through the first and second ears, respectively;

through the panel; and into the first and second mounting plates, respectively;

and further wherein:

the first and second retention fasteners extend between the first and second mounting plates, respectively, and the panel;

each retention fastener has a head;

each mounting ear includes a clearance aperture larger than the head and in registry with a respective head.

2. The combination of claim 1 wherein:

each mounting plate includes a plurality of mounting holes spaced apart by a first dimension;

the first and second mounting fasteners extend through mounting holes in the first and second ears which are spaced apart by a second dimension which is at least six times the first dimension.

3. The combination of claim 2 wherein the tank is a liquid holding tank.

4. The combination of claim 1 wherein:

each mounting plate includes a plurality of mounting holes; and for each mounting plate, the said plurality of mounting holes and the retention fastener are along a linear axis.

5. A method for mounting a holding tank to a vehicle chassis including:

providing an elongate chassis structure having a plurality of panels and a structure interior;

supplying a plurality of mounting plates, each plate having a pair of plate mounting holes therein;

furnishing a holding tank having a pair of spaced-apart mounting ears, each ear having a pair of ear mounting holes therein;

inserting the mounting plates into the interior;

extending a separate retention fastener having a head through one of the panels;

each ear further having a clearance aperature larger then the head;

threading each retention fastener to a respective one of the mounting plates such that the head of each retention fastener is received within the clearance aperture in a respective mounting ear; and attaching each ear to a respective mounting plate.

6. The method of claim 5 wherein:

the said one of the panels has an inner surface;

each mounting plate has a mounting surface; and the mounting surface and the inner surface are conformably shaped.

7. The method of claim 6 wherein the inner surface and the mounting surface are substantially flat.

8. The method of claim 7 wherein the chassis structure has a slot therealong and the inserting step includes moving the plates through the slot to the structure interior.

9. The method of claim 8 wherein the threading step is followed by the step of welding a strip along the slot, thereby forming an enclosed chassis channel.

* * * * *